US010170091B1

(12) United States Patent
Tabata

(10) Patent No.: US 10,170,091 B1
(45) Date of Patent: Jan. 1, 2019

(54) ELECTRONIC WIND INSTRUMENT, METHOD OF CONTROLLING THE ELECTRONIC WIND INSTRUMENT, AND COMPUTER READABLE RECORDING MEDIUM WITH A PROGRAM FOR CONTROLLING THE ELECTRONIC WIND INSTRUMENT

(71) Applicant: CASIO COMPUTER CO., LTD., Shibuya-ku, Tokyo (JP)

(72) Inventor: Yuji Tabata, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/007,202

(22) Filed: Jun. 13, 2018

(30) Foreign Application Priority Data

Jun. 29, 2017 (JP) ..... 2017-127636

(51) Int. Cl.
*G10H 1/22* (2006.01)
*G10H 1/34* (2006.01)

(52) U.S. Cl.
CPC ..... *G10H 1/22* (2013.01); *G10H 1/344* (2013.01); *G10H 2210/265* (2013.01); *G10H 2220/361* (2013.01); *G10H 2230/221* (2013.01); *G10H 2230/241* (2013.01)

(58) Field of Classification Search
CPC .... G10H 1/22; G10H 1/344; G10H 2210/265; G10H 2220/361; G10H 2230/221; G10H 2230/241
USPC ..... 84/658
See application file for complete search history.

(56) References Cited

U.S. PATENT DOCUMENTS 2,301,184 A * 11/1942 Arnold ..... G10H 1/32 84/742
2,355,287 A * 8/1944 Firestone ..... G10L 25/00 315/237
3,439,106 A * 4/1969 Goodale ..... G10H 1/46 84/711
3,558,795 A * 1/1971 Barcus ..... G10D 9/00 84/730
4,342,244 A * 8/1982 Perkins ..... G10H 1/32 84/171
6,002,080 A * 12/1999 Tanaka ..... G10D 7/00 84/609

(Continued)

FOREIGN PATENT DOCUMENTS

JP H03219295 A 9/1991
JP H07072853 A 3/1995

(Continued)

*Primary Examiner* — David Warren
(74) *Attorney, Agent, or Firm* — Holtz, Holtz & Volek PC

(57) ABSTRACT

An electronic wind instrument is provided, which is capable of representing a wide range of performances using a tonguing operation. The electronic wind instrument has at least one sensor, a sound source for generating a tone, and a controller. The controller controls a tonguing performance detecting process for detecting a tonguing performance played by the player based on the output value from the one sensor, and a tone muting process for muting the tone output from the speaker in accordance with the lip position of the player determined in the lip position determining process, while the tonguing performance is being detected in the tonguing performance detecting process.

8 Claims, 8 Drawing Sheets

(56) References Cited

U.S. PATENT DOCUMENTS

| | | | | |
|---|---|---|---|---|
| 6,316,710 | B1 * | 11/2001 | Lindemann | G10H 7/02 84/601 |
| 7,049,503 | B2 | 5/2006 | Onozawa et al. | |
| 7,754,957 | B2 * | 7/2010 | Ohta | G10F 1/02 84/615 |
| 9,159,321 | B2 * | 10/2015 | Cheung | G10L 15/25 |
| 9,386,147 | B2 * | 7/2016 | McDysan | H04M 3/4286 |
| 9,653,057 | B2 | 5/2017 | Harada et al. | |
| 2003/0066414 | A1 * | 4/2003 | Jameson | G10H 3/125 84/741 |
| 2005/0217464 | A1 * | 10/2005 | Onozawa | G10H 1/055 84/723 |
| 2007/0017346 | A1 * | 1/2007 | Masuda | G10H 1/053 84/600 |
| 2007/0017352 | A1 * | 1/2007 | Masuda | G10H 1/053 84/658 |
| 2009/0019999 | A1 * | 1/2009 | Onozawa | G10H 1/34 84/658 |
| 2009/0020000 | A1 * | 1/2009 | Onozawa | G10D 7/00 84/723 |
| 2014/0190332 | A1 * | 7/2014 | Winquist | G10D 9/06 84/384 |
| 2016/0275929 | A1 * | 9/2016 | Harada | G10H 1/46 |
| 2018/0075831 | A1 * | 3/2018 | Toyama | G10H 1/06 |
| 2018/0082664 | A1 * | 3/2018 | Sasaki | G10B 3/22 |

FOREIGN PATENT DOCUMENTS

| | | | | |
|---|---|---|---|---|
| JP | 2009258750 | A | 11/2009 | |
| JP | 2016177026 | A | 10/2016 | |
| WO | WO 2007059614 | A1 * | 5/2007 | G05G 1/52 |
| WO | WO 2008141459 | A1 * | 11/2008 | A61F 4/00 |

* cited by examiner

TONE MUTING EFFECT TABLE

ELECTRONIC WIND INSTRUMENT, METHOD OF CONTROLLING THE ELECTRONIC WIND INSTRUMENT, AND COMPUTER READABLE RECORDING MEDIUM WITH A PROGRAM FOR CONTROLLING THE ELECTRONIC WIND INSTRUMENT

CROSS-REFERENCE TO RELATED APPLICATION

The present application is based upon and claims the benefit of priority from the prior Japanese Patent Application No. 2017-127636, filed Jun. 29, 2017, the entire contents of which are incorporated herein by reference.

BACKGROUND OF THE INVENTION

1. Field of the Invention

The present invention relates to an electronic wind instrument, a method of controlling the electronic wind instrument, and a computer readable recording medium with a program stored therein for controlling the electronic wind instrument.

2. Description of the Related Art

An electronic wind instrument is proposed in Japanese Unexamined Patent Publication No. 2009-258750, which instrument employs a performance operator reproduced from a mouthpiece and a reed of a natural-wood wind instrument.

In a performance of the natural-wood wind instrument, a tonguing operation is employed by a player, that is, while the player is playing the natural-wood wind instrument, he/she touches a vibrating reed tightly with his/her tongue to make a tone mute quickly, touches the reed gently with his/her tongue to change a tone volume, and/or holds the reed with his/her tongue to rise a breathing pressure and instantly releases his/her tongue from the reed to produce a strong attack tone.

Meanwhile, in the electronic wind instrument, since a sensor is used to detect that the player has touched the reed to obtain a tone muting effect, it is hard for the electronic wind instrument to give such enough performance representation as given by the tonguing performance played on the natural-wood wind instrument. An electronic wind instrument is expected, that is capable of providing not only a simple tone muting effect but also a wide range of performance representations given by the tonguing performance.

The present invention provides an electronic wind instrument which is capable of giving a wide range of performance representations by the tonguing performance, a method of controlling the electronic wind instrument, and a computer readable recording medium with a program stored therein for controlling the electronic wind instrument.

SUMMARY OF THE INVENTION

According to one aspect of the invention, there is provided an electronic wind instrument which comprises at least one sensor, and a processor which performs a lip position determining process for determining a lip position of a player based on at least one output value from the at least one sensor, a tonguing performance detecting process for detecting a tonguing performance played by the player based on the output value from the sensor, and a tone muting process for muting a tone generated by the player's performance in accordance with the lip position determined in the lip position determining process, while the tonguing performance is being detected in the tonguing performance detecting process.

BRIEF DESCRIPTION OF THE DRAWINGS

The present invention will be more understood with reference to the following detailed descriptions with the accompanying drawings.

DETAILED DESCRIPTION OF THE PREFERRED EMBODIMENTS

Now, the embodiment of the present invention will be described with reference to the accompanying drawings in detail.

Figure 1A:
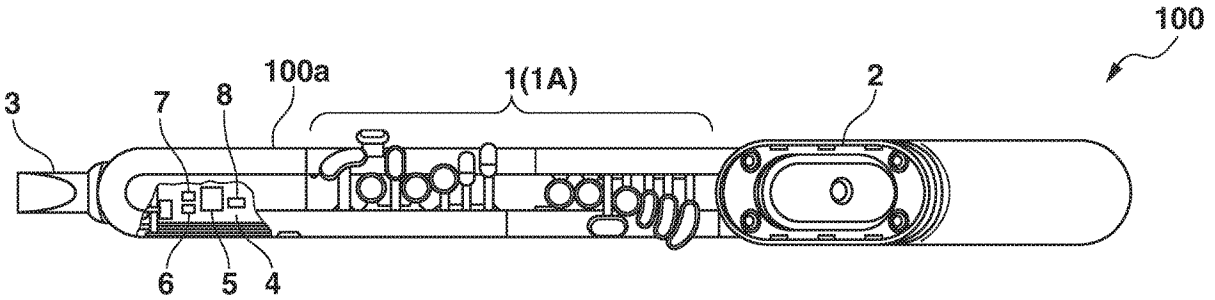
FIG. 1A is a front view showing an electronic wind instrument according to the embodiment of the present invention, a part of which instrument is partially cut off to illustrate the inside of the instrument.
Figure 1B:
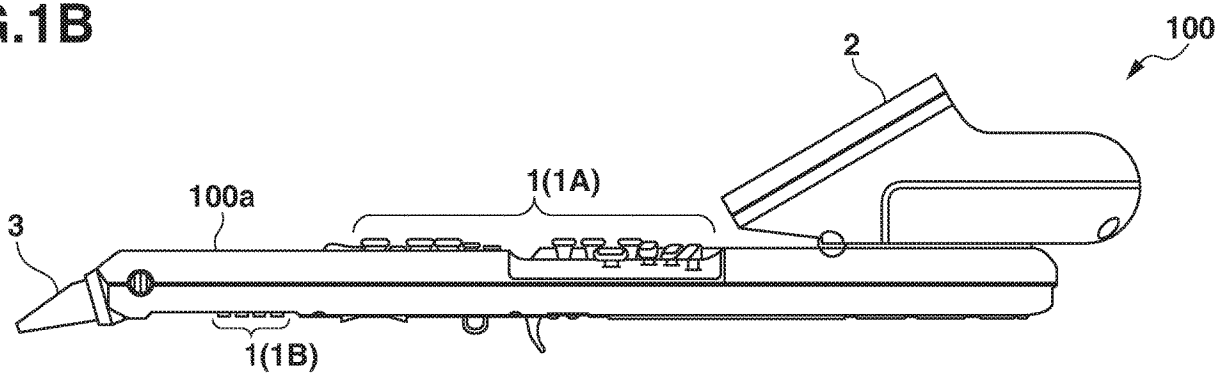
FIG. 1B is a side view showing the electronic wind instrument according to the embodiment of the present invention.

FIG. 1A and FIG. 1B are views showing an electronic wind instrument according to the embodiment of the present invention. FIG. 1A is a front view showing the electronic wind instrument 100 according to the embodiment of the invention, the tube part 100*a* thereof being partially cut off to illustrate the inside of the wind instrument. FIG. 1B is a side view showing the electronic wind instrument 100 according to the embodiment of the invention.

Figure 2:
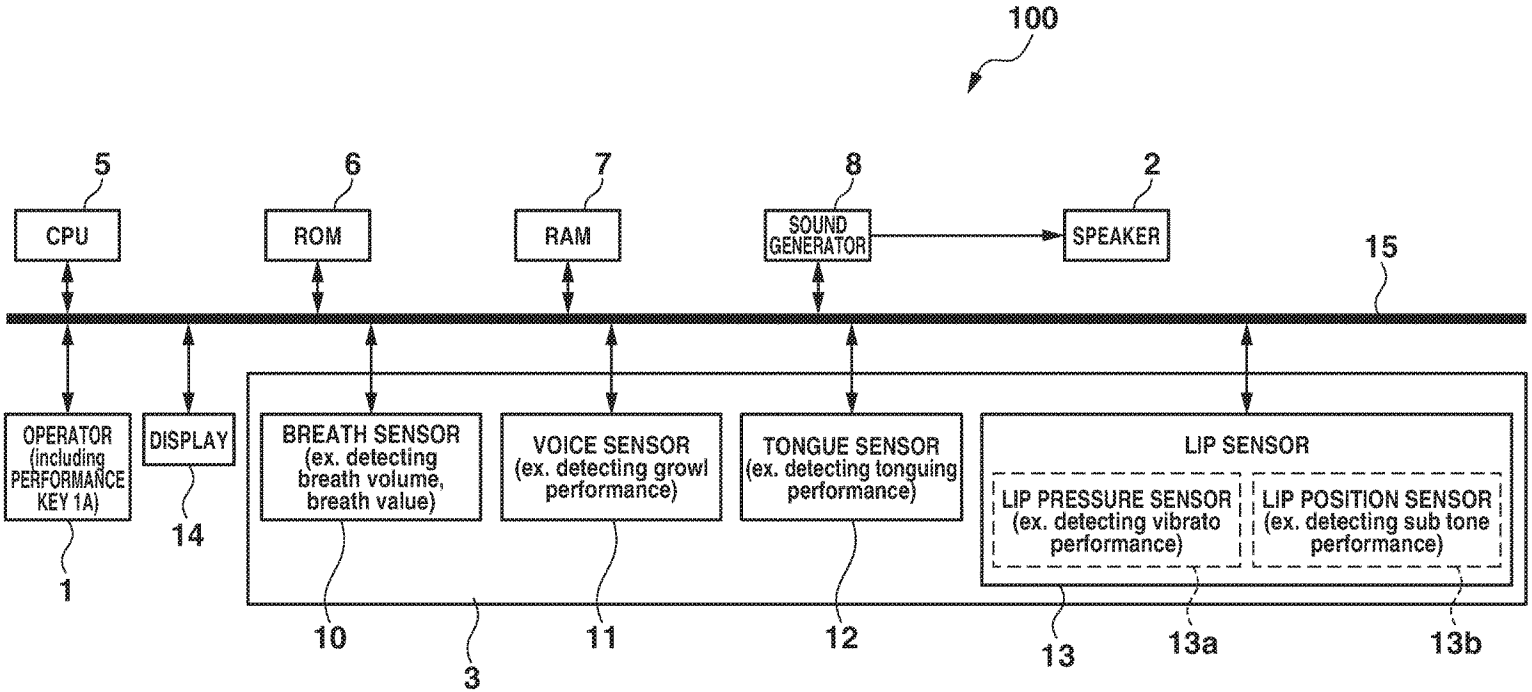
FIG. 2 is a block diagram showing the configuration of a controlling system of the electronic wind instrument.

FIG. 2 is a block diagram showing a configuration of the controlling system of the electronic wind instrument 100 according to the embodiment of the present invention.

Figure 3:
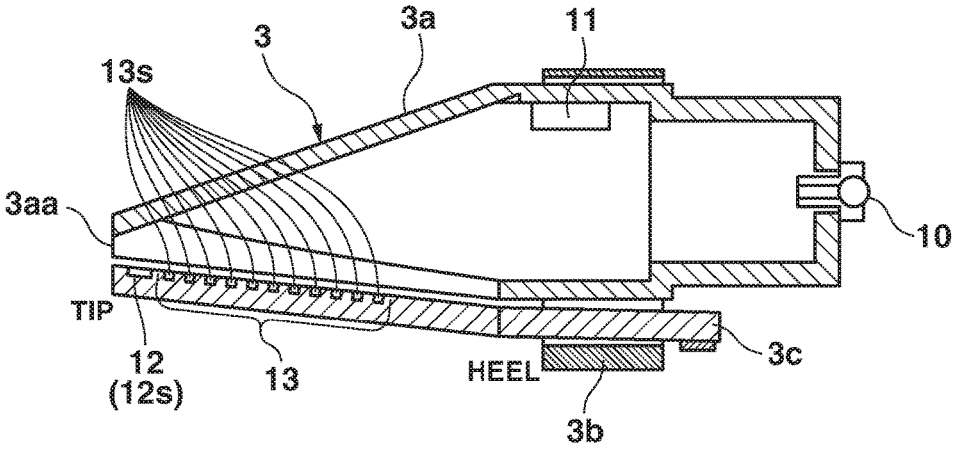
FIG. 3 is a cross sectional view showing a mouthpiece of the electronic wind instrument according to the embodiment of the present invention.

FIG. 3 is a cross sectional view showing a mouthpiece 3 of the electronic wind instrument 100 according to the embodiment of the invention.

In the present embodiment of the invention, a saxophone is taken and explained as an example of the electronic wind instrument 100. The electronic wind instrument 100 according to the invention may be any electronic wind instrument other than the saxophone, and for example, may be an electronic clarinet.

As shown in FIG. 1A and FIG. 1B, the electronic wind instrument 100 is provided with the tube part 100*a* formed in a saxophone shape, an operator 1 including plural performance keys 1A arranged on the outer surface of the tube part 100*a*, a speaker 2 provided on a bell side of the tube part 100*a*, and the mouthpiece 3 provided on the neck side of the tube part 100*a*.

As shown in FIG. 1A, the electronic wind instrument 100 has a substrate 4 mounted within the tube part 100*a* of the wind instrument 100. On the substrate 4, there are provided CPU (Central Processing Unit) 5, ROM (Read Only Memory) 6, RAM (Random Access Memory) 7, and a sound generator 8.

Further, as shown in FIG. 3, the mouthpiece 3 is composed of a mouthpiece body 3*a*, a fixing metal 3*b*, a reed 3*c*, a breath sensor 10, and a voice sensor 11.

The reed 3*c* has a tongue sensor 12 and a lip sensor 13. As will be described later, the lip sensor 13 will function as a lip pressure sensor 13*a* and a lip position sensor 13*b*.

The electronic wind instrument 100 has a display 14 (Refer to FIG. 2) provided on the external surface of the tube part 100*a*.

For instance, the display 14 is composed of a liquid crystal display with a touch sensor, which not only displays various sorts of data but also allows a player or a user to perform various setting operations.

The various elements such as the operator 1, the CPU 5, the ROM 6, the RAM 7, the sound generator 8, the breath sensor 10, the voice sensor 11, the tongue sensor 12, the lip sensor 13, and the display 14 are connected to each other through a bus 15.

The operator 1 is an operator which the player (the user) operates with his/her finger(s). The operator 1 includes performance keys 1A for designating a pitch of a tone, and setting keys 1B for setting a function of changing a pitch in accordance with a key of a musical piece and a function of fine adjusting the pitch.

The speaker 2 outputs a musical tone signal supplied from the sound generator 8, which will be described in detail later. In the present embodiment of the invention, the speaker 2 is built in the electronic wind instrument 100 (a built-in type), but the speaker 2 can be constructed to be connected to an output board (not shown) of the electronic wind instrument 100 (a detachable type).

The CPU 5 serves as a controller for controlling the whole operation of the electronic wind instrument 100. The CPU 5 reads a designated program from the ROM 6 and expands it over the RAM 7 to execute the expanded program, performing various processes.

Further, depending on a breathing operation detected by the breath sensor 10, the CPU 5 outputs control data to the sound generator 8 to control tone generation and/or tone muting of the tone output from the speaker 2.

The ROM 6 is a read only memory which stores programs used by the CPU 5, that is, a controller to control operation of various elements of the electronic wind instrument 100 and also stores various data used by the CPU 5 to perform various processes such as a breath detecting process, a voice detecting process, a lip position detecting process, a tonguing operation detecting process, a tone muting effect deciding process, a synthetic ratio deciding process, an envelop deciding process, and a tone generation instructing process.

The RAM 7 is a rewritable storage and is used as a work area which temporarily stores a program and data obtained by various sensors such as the breath sensor 10, the voice sensor 11, the tongue sensor 12, and the lip sensor 13.

Further, the RAM 7 serves as a storage which stores various sorts of information including, for instance, breath detecting information, voice detecting information, lip position detecting information, tonguing operation detecting information, tone muting effect information, synthetic ratio information, envelop information, and tone generation instructing information. These sorts of information are obtained respectively, when the CPU 5 has performed the breath detecting process, the voice detecting process, the lip position detecting process, the tonguing operation detecting process, the tone muting effect deciding process, the synthetic ratio deciding process, the envelop deciding process, and the tone generation instructing process, contents of which are stored in the ROM 6.

In accordance with an instruction of the CPU 5, these sorts of information are supplied to the sound generator 8 as control data for controlling the tone generation and/or tone muting of the tone output from the speaker 2.

The sound generator 8 generates a musical tone signal in accordance with the control data which the CPU 5 generates based on the operation information of the operator 1 and the data obtained by the sensors. The generated musical tone signal is supplied to the speaker 2.

The mouthpiece 3 is a part which the player holds in his/her mouth, when the player (user) plays the wind instrument. The mouthpiece 3 is provided with various sensors including the breath sensor 10, the voice sensor 11, the tongue sensor 12, and the lip sensor 13 to detect various playing operations performed by the player using tongue, breath, and voice.

More specifically, these sensors including the breath sensor 10, the voice sensor 11, the tongue sensor 12, and the lip sensor 13 will be described. Hereinafter, only the functions of these sensors will be described, but the description of the functions of these sensors by no means prevents from providing these sensors with any additional function.

The breath sensor 10 has a pressure sensor which measures a breathing volume and a breathing pressure, when the player has blown breath from a breathing opening 3*aa* formed at the tip of the mouthpiece body 3*a*, and outputs a breath value. The breath value output from the breath sensor 10 is used by the CPU 5 to set tone generation and/or tone mute of a musical tone and a tone volume of the musical tone.

The voice sensor 11 has a microphone. The voice sensor 11 detects vocal data (a growl waveform) of growl performance by the player. The vocal data (growl waveform) detected by the voice sensor 11 is used by the CPU 5 to determine a synthetic ratio of growl waveform data.

The tongue sensor 12 is a pressure sensor or a capacitance sensor, which has a detector 12*s* provided at the forefront (tip side) of the reed 3*c*, as shown in FIG. 3. The tongue sensor 12 judges whether the tongue of the player has touched the forefront end of the reed 3*c*. In other words, the tongue sensor 12 judges whether the player has performed a tonguing operation.

The judgment made by the tongue sensor 12 on whether the tongue of the player has touched the forefront end of the reed 3*c* is used by the CPU 5 to set a tone muting effect of a musical tone.

More specifically, the waveform data to be output is adjusted depending on both the state, in which the tongue sensor 12 has detected that the tongue is in touch with the forefront end of the reed 3*c* and the state, in which the breath value is being output by the breath sensor 10.

In setting the tone muting effect, the output waveform data is adjusted such that a tone volume will be turned down and the adjusted output waveform can be changed form the original waveform or can keep the same as the original waveform, either will do.

More specifically, the output waveform data is adjusted depending on the state in which the tongue has touched the end of the reed 3*c*, judged by the tongue sensor 12 and the breath value output by the breath sensor 10. In the tone muting effect setting, the waveform data to be output is adjusted such that a tone volume will be turned down and the output waveform can be changed or keep the same, either will do.

The lip sensor (pressure sensor or capacitance sensor) 13 is provided with plural detectors 13*s* arranged from the forefront (the tip side) toward the rear (the heel side) of the reed 3*c*. The lip sensor 13 functions as a lip pressure sensor 13*a* and a lip position sensor 13*b*.

More particularly, the lip sensor 13 performs the function of the lip position sensor 13*b* which detects a position of the lip on the reed 3*c* based on output values from the plural detectors 13*s* and the function of the lip pressure sensor 13*a* which detects the touching pressure applied by the touching lips.

When the plural detectors 13*s* detect that the lip touches the reed 3*c*, the CPU 5 uses values output from such plural detectors 13*s* to determine the center (hereinafter, "centroid position") of the area where the lip has touched, whereby a "lip position" is obtained.

For instance, when the lip sensor 13 is composed of plural pressure sensors, the lip sensor 13 detects a touched pressure (lip pressure) applied by the touching lip and the CPU 5 detects a lip position based on a pressure variation detected by the pressure sensors.

When the lip sensor 13 is composed of plural capacitance sensors, the lip sensor 13 detects a capacitance variation and the CPU 5 detects the lip position based on the capacitance variation detected by the capacitance sensors.

The lip pressure detected by the lip sensor 13 serving as the lip pressure sensor 13*a* and the lip position detected by the lip sensor 13 serving as the lip position sensor 13*b* are used to control a vibrato performance and a sub-tone performance.

More particularly, the CPU 5 detects the vibrato performance based on variation in the lip pressure to effect a process corresponding to the vibrato and detects the sub-tone performance based on variation in the lip position (variation of the lip position and variation of the lip touching area and position) to effect a process corresponding to the sub-tone.

Hereinafter, a method of deciding a lip position will be described briefly, in the case where the lip sensor 13 is composed of the plural capacitance sensors.

Figure 4A:
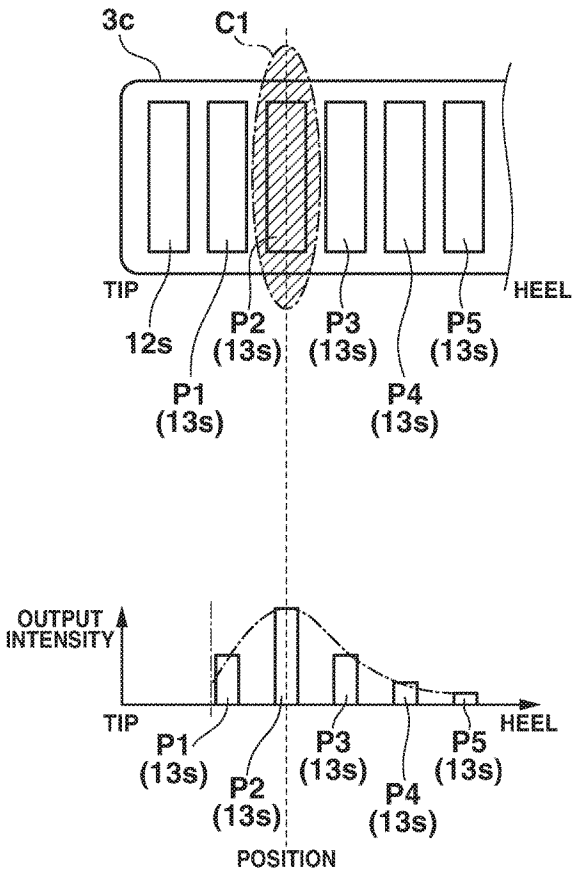
FIG. 4A and FIG. 4B are views schematically showing an area of a reed where the lip touches and output values (output intensities) from the plural detectors of the lip sensor.
Figure 4B:
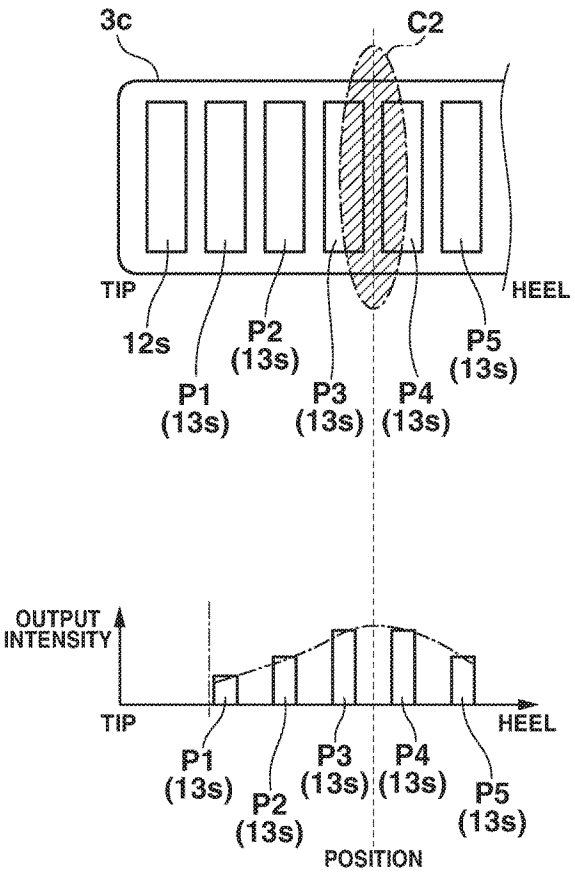

FIGS. 4A and 4B are views schematically showing a position of the reed 3*c* where the lip touches and output values (output intensities) from the plural detectors 13*s* of the lip sensor 13.

As shown in FIG. 4A and FIG. 4B, symbols P1, P2, P3, . . . and so on, indicating the numbers of the detectors 13*s*, are given respectively to the plural detectors 13*s* of the lip sensor 13 provided on the reed 3*c* from the forefront side (tip side) toward the base side (heel side) of the reed 3.

For example, when the player holds a lip touching range C1 with his/her lips most tightly as shown in FIG. 4A, a distribution of the output intensities will be obtained with the maximum output intensity output from the detector 13*s* "P2" corresponding to the lip touching range C1.

Meanwhile, when the player holds a lip touching range C2 (a range between the detectors 13*s* "P3" and "P4") with his/her lips most tightly, as shown in FIG. 4B, the distribution of the output intensities will be obtained with the maximum output intensities output from the detectors 13*s* "P3" and "P4" corresponding to the lip touching range C2.

As will be understood from FIG. 4A and FIG. 4B, not only the detectors 13*s* corresponding to the lip touching ranges C1 and C2 but also the detectors 13*s* adjacent to aforesaid detectors 13*s* (the detectors 13*s* "P1" and "P3", "P4", and "P5" in FIG. 4A and the detectors 13*s* "P1", "P2", and "P5" in FIG. 4B) will react.

As described above, in detecting the lip touching range by the detectors 13*s*, since it is detected that the lip touches a wide range, it will be necessary to determine which position of the reed 3*c* has likely been touched by the lip.

Provisionally, the CPU 5 deduces the center of the lip touching range, that is, the "centroid position" of the lip touching range, which will be described with reference to FIG. 5.

Figure 5:
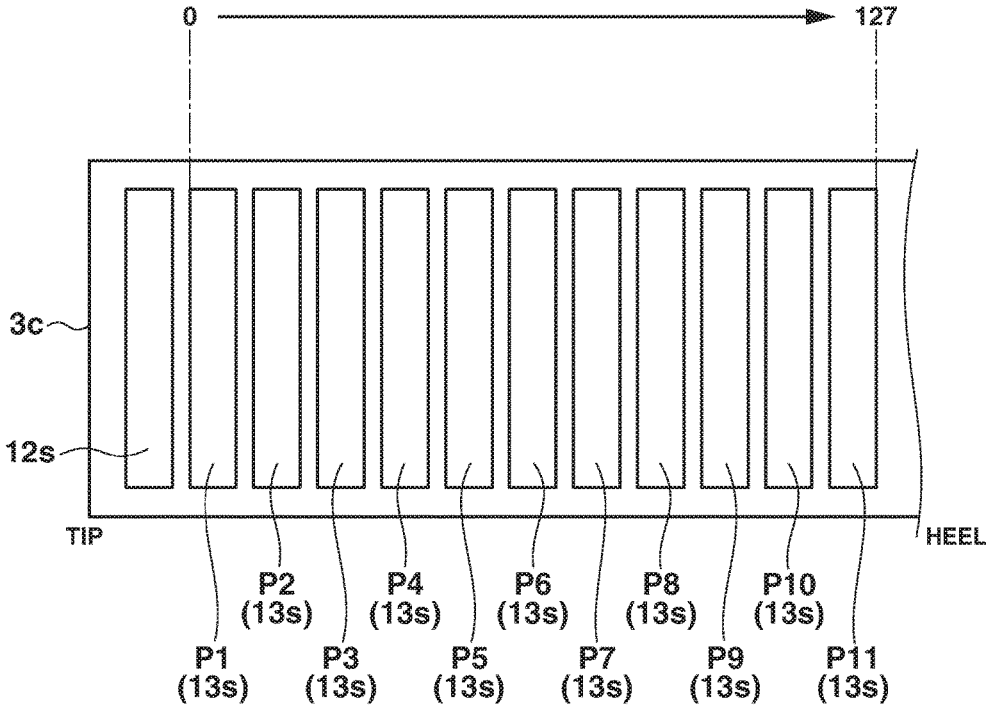
FIG. 5 is a view schematically showing the detector of a tongue sensor and the plural detectors of the lip sensor provided on the reed of the electronic wind instrument according to the embodiment of the present invention.

FIG. 5 is a view schematically showing the detector 12*s* of the tongue sensor 12 and the plural detectors 13*s* of the lip sensor 13 provided on the reed 3*c*.

Similarly to FIG. 4A and FIG. 4B, the symbols P1, P2, P3, . . . and so on, indicating the numbers of the detectors 13*s*, are given respectively to the plural detectors 13*s* of the lip sensor 13 disposed on the reed 3*c* from the tip side toward the heel side.

More specifically, the centroid position "$x_G$" of the lip touching range is calculated by the following mathematical formula (1) to decide the lip position, where the positions of the symbols "P1" to "P11" are denoted by position numbers "$X_i$" ($X_i$=1 to 11), respectively and the symbols "P1" to "P11" of the detector 13*s* supply output values "$m_i$", respectively.

In the present embodiment of the invention, the output values supplied directly from the detector 13*s* are not used but the output values with noises removed are used as the output values "$m_i$".

$$x_G = \frac{\sum_{i=1}^{n} m_i x_i}{\sum_{i=1}^{n} m_i} \qquad \text{FORMULA (1)}$$

where "n" denotes the number of detectors 13*s*. The formula (1) is the same as the formula which is generally used to calculate a centroid position.

For instance, when the output values supplied from the positions "P1" to "P11" of the detectors 13*s* are [0, 0, 0, 0, 90, 120, 150, 120, 90, 0, 0], then the centroid position "$x_G$" will be given as follows:

$$x_G=(5\times90+6\times120+7\times150+8\times120+9\times90)/(90+120+150+120+90)=7.0 \qquad \text{FORMULA (2)}$$

In the process performed in the musical instrument, the centroid position "$x_G$" of the lip touching range is expressed in terms of integer values from "0" to "127" (binary number of 7 bits), as shown on the upper side in FIG. 5.

The transformation of expression of the centroid position "$x_G$" to the bit representation is similar to the transformation to the general bit representation, but since the position numbers "$x_i$", "1" to "11", are given to the detectors 13*s* "P1" to "P11", respectively, in the present embodiment of the invention, the minimum value of the centroid position "$x_G$" is "11111" but not "0".

Therefore, when a value "0" is assigned to the centroid position "$x_G$" while this centroid position "$x_G$" takes "1", a value (6.0 in the aforesaid case) calculated by subtracting "1" from the value of the centroid position "$x_G$" is used for transformation to the bit representation. In short, the value 6.0 is divided by the maximum number "11" of detectors 13*s* ("P1" to "P11") and then multiplied by 127.

In the present embodiment of the invention, as described above, in consideration of the influence of noises included in each output value of the detector 13*s*, a value with the influence of noises removed is denoted as the output value "$m_i$" used in the FORMULA 1. More specifically, since the lip will not touch all the detectors 13*s* "P1" to "P11", it will be considered that the minimum output value "Pmin" of the detectors 13*s* depends on noises.

But the minimum output value "Pmin" of the detectors 13*s* can be less than a general noise level. Therefore, a value "NL" (=Pmin+Sv) given by the sum of the minimum output value "Pmin" and a margin of a safety value "Sv" is used as an output value generated depending on noises, and values obtained by subtracting the value "NL" from all the output values of the detectors 13*s* are used as the output value "$m_i$" of the detector 13*s* used in the FORMULA 2.

When a value of "0" or less is obtained by subtracting the value "NL" from the output value of the detectors 13*s*, then the output value of the detectors 13*s* is set to "0".

Figure 6:
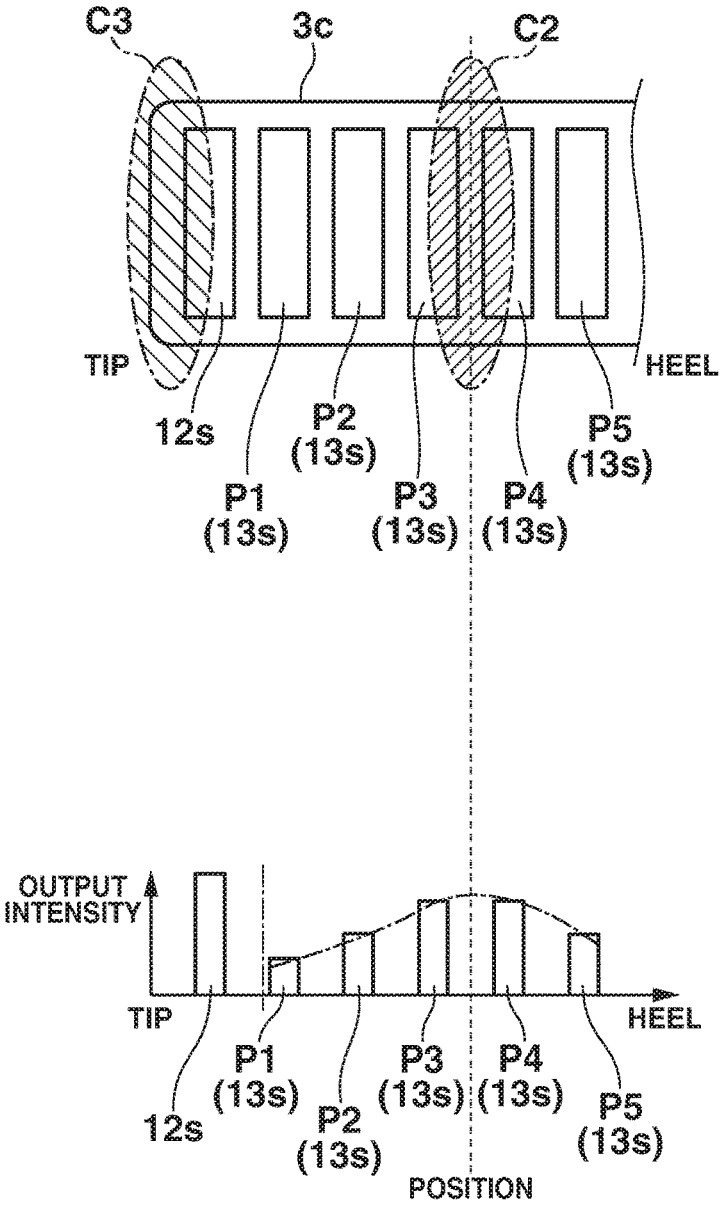
FIG. 6 is a view schematically showing a tonguing performance played on the electronic wind instrument in the present embodiment of the invention.

FIG. 6 is a view for explaining a tonguing performance played on the electronic wind instrument 100 in the present embodiment of the invention. As will be understood from FIG. 6, the player touches the detector 12*s* of the tongue sensor 12 with his/her tongue to play tonguing performance. Then, the detector 12*s* of the tongue sensor 12 generates an output value in addition to the output values generated by the detector 13*s* of the lip sensor 13.

When the detector 12*s* of the tongue sensor 12 has output the output value, the CPU 5 starts executing the tonguing process.

When a player plays a natural-wood wind instrument, the player often holds the mouthpiece deep in his/her mouth to give a crisp and clear powerful performance with a percussive tone. On the contrary, when the player gives a tender performance with a sub tone, in general the player holds the mouthpiece soft in his/her mouth.

In the present embodiment of the invention, when the output value is output from the tongue sensor 12 and the tonguing process is performed based on the characteristic of the above mentioned method of playing the wind instrument, a tone muting process is performed with consideration of the lip position, whereby various expressions of performance can be enjoyed based on a wider range of tonguing performance methods. Hereinafter, the tone muting process will be described in detail.

Figure 7:
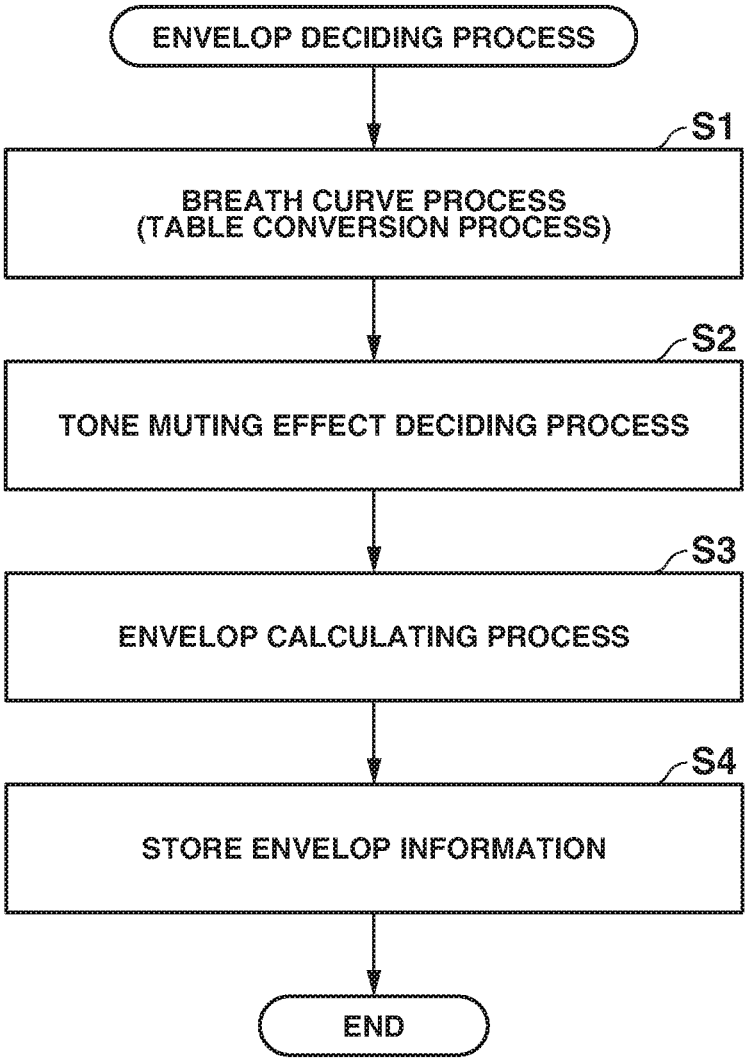
FIG. 7 is a flow chart of an envelop deciding process.

FIG. 7 is a flow chart of an envelop deciding process performed to decide an envelop at a time of tone mute. At a time other than the time of tone muting, the envelop deciding process is performed to decide a strength of a musical tone based on a breath value. The envelop deciding process that is performed at a time other than the time of tone muting is the same as the general process, and therefore the description thereof will be omitted herein. Only the envelop deciding process will be described, which will be performed in the case where a tone is reduced completely when a tonguing performance has been detected or when a tone is softened or weakened when producing it.

The CPU 5 watches whether the detector 12*s* of the tongue sensor 12 has produced an output value, and executes a tonguing performance detecting process to detect whether the player has played a tonguing performance.

When the CPU 5 has detected the tonguing performance of the player in the tonguing performance detecting process, that is, when the CPU 5 confirms that the output value output from the detector 12*s* of the tongue sensor 12 has exceeded a threshold value, the CPU 5 decides that the player has played the tonguing performance and starts performing the envelop deciding process shown in FIG. 7.

Upon detection of the tonguing performance, the CPU 5 performs a breath curve process (table conversion process) to convert a breath value (pressure value) to a strength of a musical tone (step S1 in FIG. 7), whereby a strength of a musical tone is obtained.

The CPU 5 determines a position (centroid position) of the player's lip on the mouthpiece 3 based on the output values of the lip sensor 13 to perform the tone muting effect deciding process (step S2).

Figure 8:
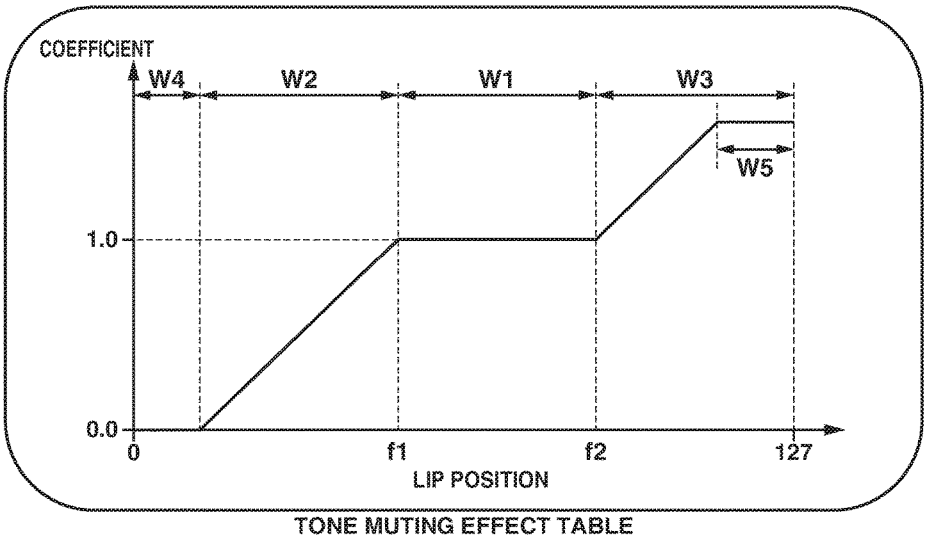
FIG. 8 is a view schematically showing the tone muting effect table.

For instance, the tone muting effect deciding process is performed based on data in a "tone muting effect table" (Refer to FIG. 8), which will be described hereinafter. FIG. 8 is a view schematically showing the tone muting effect table.

In the tone muting effect table shown in FIG. 8, the horizontal axis represents the lip position by numerals from 0 to 127.

The numeral of "0" of the horizontal axis represents that the lip stays on the tip side of the reed 3*c* and the numeral of "127" of the horizontal axis represents that the lip stays at the heel side of the reed 3*c*.

The vertical axis represents a coefficient used to control the tone muting effect corresponding to the lip position.

As shown in the tone muting effect table of FIG. 8, the lip position is divided roughly into five ranges: a standard lip range W1, a first lip range W2, a second lip range W3, a third lip range W4, and a fourth lip range W5. The standard lip range W1 is an area defined between f1 and f2 on the horizontal axis (for instance, the range between the detectors 13*s* "P4" and "P8" in FIG. 5). The first lip range W2 is defined on the tip side of the reed 3*c* or on the left side to the standard lip range W1 as seen in the tone muting effect table. The second lip range W3 is defined on the heel side of the reed 3*c* or on the right side of the standard lip range W1. The third lip range W4 is defined at the forefront side and the fourth lip range W5 is defined on the right side to the second lip range W3.

In the standard lip range W1 of the tone muting effect table shown in FIG. 8, the coefficient of "1.0" is set, and therefore, when the lip position falls in the standard lip range W1, the CPU 5 will calculate a tone muting effect value, by multiplying by the coefficient "1.0" the tonguing value that is normalized based on the output value from the detector 12*s* of the tongue sensor 12 so as to take a value from "0" to "1.0". In this case, the tone muting effect value is equivalent to the tonguing value itself.

Further, in the tone muting effect deciding process, from the tone muting effect the CPU 5 obtains a multiplication coefficient "N" for amending the strength of a musical tone that is obtained at step S1.

More specifically, the multiplication coefficient "N" can be obtained by subtracting a tone muting effect value from a value of "1.0", that is, N=1.0−(tone muting effect value). In the standard lip range W1, as described above, the multiplication coefficient "N" is given by the tonguing value itself, which is normalized so as to take a value from "0" to "1.0", based on the output value from the detector 12*s* of the tongue sensor 12, and therefore the tone muting process is executed with respect to the general tonguing value.

In an envelop calculating process at step S3, the CPU 5 multiplies the strength of a musical tone obtained at step S1 by the multiplication coefficient "N" (the tonguing value itself) and stores the obtained value in envelop information in the RAM 7 (step S4), finishing the envelop deciding process.

Further, the CPU 5 supplies the sound generator 8 with the envelop information to be used as controlling data for controlling a tone muting operation in the tone muting process.

Meanwhile, when the lip position falls in the first lip range W2, a value which is larger than 0.0 and not larger than 1.0 is set to the coefficient and the coefficient is set to become smaller than 1.0 as the lip position comes closer to the tip of the reed 3*c*.

Therefore, when the lip position falls in the first lip range W2, the CPU 5 will calculate the tone muting effect value, by multiplying by the coefficient of not larger than "1.0" the tonguing value that is normalized based on the output value from the detector 12*s* of the tongue sensor 12 so as take a value from "0" to "1.0". The calculated tone muting effect value is smaller than the tonguing value.

Further, in the tone muting effect deciding process, the CPU 5 obtains a multiplication coefficient "N" for amending the strength of a musical tone that is obtained from the tone muting effect at step S1. The multiplication coefficient "N" is obtained by calculating N=1.0−(tone muting effect value) but this multiplication coefficient "N" will be larger than the tonguing value itself in the tone muting effect.

Therefore, in the envelop calculating process at step S3, the envelop information will have less tone muting effect, which information is obtained by multiplying the strength of a musical tone obtained at step S1 by the multiplication coefficient "N". In other words, the CPU 5 obtains the envelop information for reducing a tone level less than the envelop information obtained in the standard lip range W1.

The envelop information obtained in this fashion is stored in the envelop information of the RAM 7 (step S4), and the envelop deciding process finishes. Then, the CPU 5 supplies the sound generator 8 with such envelop information as control data to perform the tone muting process, thereby controlling tone mute. In other words, the CPU 5 controls the tone muting process so as to reduce a tone to a less level than in the standard lip range W1.

The tone muting effect in accordance with the detected tonguing performance is smaller in the first in the lip position W2 than the standard lip range W1. That is, the tone muting effect needs a longer time to make the tone output from the speaker 2 drown out in the first lip range W2 than the standard lip range W1.

As described, when the lip position falls in the first lip range W2, the tone muting process is performed to reduce a tone less effectively than the case where the tone muting process using the tonguing value itself is performed.

Because of this season, when the player moves his/her lip to the first lip range W2, all the player has to do is just performing a normal tonguing operation to perform a half tonguing performance which is hard for beginners to perform.

When the player moves his/her lip toward the forefront side from the first lip range W2 to the third lip range W4 on the forefront side, since the coefficient is set to 0.0 in the third lip range W4 as shown in FIG. 8, the CPU 5 does not perform tone mute depending on the tonguing operation, in other words, the CPU 5 performs tone mute in accordance with the strength of a musical tone obtained at step S1.

In other words, the tone muting effect in accordance with the detected tonguing performance is not produced in the third lip range W4, that is, the tone output from the speaker 2 is not drowned out in the tone muting process in accordance with the tonguing performance.

On the contrary, as shown in FIG. 8, when the lip position falls in the second lip range W3, a value which is larger than 1.0 is set to the coefficient, and the coefficient will become larger as the lip position comes closer to the heel of the reed 3*c*.

In the present embodiment of the invention, when the coefficient increases and reaches some level in the second lip range W3, then the coefficient keeps constant thereafter in the region on the heel side of the reed 3*c* (the fourth lip range W5). Therefore, it will be possible to prevent a bad influence on the performance from noises due to an abrupt tone mute. Of course, there is no need to prepare the region in which the coefficient keeps constant. It will be possible to set the coefficient to increase constantly.

In this case, the CPU 5 will calculate a tone muting effect value, by multiplying by the coefficient of larger than "1.0" the tonguing value normalized so as take a value from "0" to "1.0" based on the output value from the detector 12*s* of the tongue sensor 12. The calculated tone muting effect value is larger than the tonguing value.

Similarly to the above described, in the tone muting effect deciding process, the CPU 5 obtains from the tone muting effect the multiplication coefficient "N" for amending the strength of a musical tone obtained at step S1. The multiplication coefficient "N" obtained by calculating N=1.0−(tone muting effect value) will be smaller than the tonguing value itself in the tone muting effect.

When the tone muting effect value obtained by multiplying the tonguing value by the coefficient of larger than "1.0", which is larger than the tonguing value, should exceed "1.0", then the obtained tone muting effect value is set to "1.0" and the multiplication coefficient "N" obtained based on such tone muting effect value of "1.0" will be set to "0.0".

Therefore in the envelop calculating process at step S3, the CPU 5 obtains the envelop information obtained by multiplying the strength of a musical tone obtained at step S1 by the multiplication coefficient "N", which has a large tone muting effect, in other words, the CPU 5 will obtain the envelop information that will control tone mute so as to reduce a tone to a more decreased level than in the standard lip range W1.

The obtained envelop information is stored in the envelop information of the RAM 7 (step S4), and the envelop deciding process finishes. Then, the CPU 5 supplies the sound generator 8 with the envelop information as control data to perform the tone muting process, thereby controlling tone mute.

In other words, the CPU 5 controls the tone mute so as to reduce a tone to a more decreased level than in the standard lip range W1.

That is, the tone muting effect in accordance with the detected tonguing performance is larger in the second lip range W3 than the standard lip range W1. In other words, the tone muting effect needs a shorter time to make the tone output from the speaker 2 drown out in the second lip range W3 than the standard lip range W1.

As described above, in the electronic wind instrument 100 according to the present embodiment of the invention, the player is allowed to enjoy the tone mute by performing an average tonguing operation when his/her lip position stays in the vicinity of the center of the lip sensor 13. When his/her lip position stays on the tip side of the reed 3*c*, the player can perform the tone mute by performing the tonguing operation suitable for providing a tender performance with a sub tone. Further, when his/her lip position stays on the heel side of the reed 3*c*, the player can perform the tone mute by performing the tonguing operation suitable for giving a crisp and clear powerful performance with a percussive tone.

The electronic wind instrument 100 according to the present embodiment of the invention allows the player to make the strength of a tone generation soft or weak (a tone generating strength weakening or softening controlling operation including a complete tone muting operation) by performing a wide range of tonguing performance, and can be used to give a wide range of performance expressions.

In the above description, the electronic wind instrument 100 according to the specific embodiment of the invention has been described, but the present invention is not restricted to the mentioned above. For instance, the reed 3*c* with the capacitance sensor provided thereon as a touching sensor has been explained, but this touching sensor can be provided on the mouthpiece 3.

The embodiment of the invention in which one of the parameters of MIDI "mute" is considered to be adjusted has been described, but it will be possible to change not only a tone volume but also a waveform of a tone by using the parameters of the "mute".

Although specific embodiments of the invention have been described in the foregoing detailed description, it will be understood that the invention is not limited to the particular embodiments described herein, but modifications and rearrangements may be made to the disclosed embodiments while remaining within the scope of the invention as defined by the following claims. It is intended to include all such modifications and rearrangements in the following claims and their equivalents.

What is claimed is:

1. An electronic wind instrument comprising:

at least one sensor, and a processor which performs a lip position determining process for determining a lip position of a player based on at least one output value from the at least one sensor;

a tonguing performance detecting process for detecting a tonguing performance played by the player based on the output value from the sensor; and a tone muting process for muting a tone generated by the player's performance in accordance with the lip position determined in the lip position determining process, while the tonguing performance is being detected in the tonguing performance detecting process.

2. The electronic wind instrument according to claim 1, further comprising:

a mouthpiece mounted on an instrument body; and a reed provided on the mouthpiece, wherein at least the one sensor is provided on either of the mouthpiece or the reed, wherein the player touches the mouthpiece and/or the reed with his/her tongue or lip.

3. The electronic wind instrument according to claim 1, wherein the tone muting process mutes the tone generated by the player's performance in accordance with the lip position determined in the lip position determining process, while the tonguing performance is being detected in the tonguing performance detecting process.

4. The electronic wind instrument according to claim 1, wherein a tone muting effect produced in the tone muting process in accordance with the tonguing performance detected in the tonguing performance detecting process is smaller when the lip position of the player determined in the lip position determining process falls in a first lip range defined on a tip side of the reed provided on the mouthpiece than in the case where the determined lip position falls in a standard lip range defined between the tip side and a heel side of the reed on the mouthpiece.

5. The electronic wind instrument according to claim 1, wherein a tone muting effect produced in the tone muting process in accordance with the tonguing performance detected in the tonguing performance detecting process is larger when the position of the lip of the player determined in the lip position determining process falls in a second lip range defined on a heel side of the reed provided on the mouthpiece than in the case where the determined lip position falls in a standard lip range defined between the heel side and a tip side of the reed on the mouthpiece.

6. The electronic wind instrument according to claim 1, wherein a tone muting effect is not produced in the tone muting process in accordance with the tonguing performance detected in the tonguing performance detecting process, when the lip position of the player determined in the lip position determining process falls in a third lip range defined between the forefront of the reed and a first tip range defined on a tip side of the reed of the mouthpiece.

7. A method of making a computer mounted on an electronic wind instrument execute:

a lip position determining process for determining a lip position of a player based on at least one output value from an at least one sensor;

a tonguing performance detecting process for detecting a tonguing performance played by the player based on the at least one output value from the at least one sensor; and a tone muting process for muting a tone generated by the player's performance in accordance with the lip position determined in the lip position determining process, while the tonguing performance is being detected in the tonguing performance detecting process.

8. A non-transitory computer-readable recording medium with an executable program stored thereon, wherein a computer is mounted on an electronic wind instrument having at least one sensor, the executable program, when installed on the computer, making the computer execute:

a lip position determining process for determining a lip position of a player based on at least one output value from the at least one sensor;

a tonguing performance detecting process for detecting a tonguing performance played by the player based on the at least one output value from the at least one sensor; and a tone muting process for muting the tone generated by the player's performance in accordance with the lip position of the player determined in the lip position determining process, while the tonguing performance is being detected in the tonguing performance detecting process.

* * * * *